United States Patent [19]

Yabe

[11] Patent Number: 4,688,673

[45] Date of Patent: Aug. 25, 1987

[54] FOLDUP PAPER CONTAINER

[76] Inventor: Yoshiharu Yabe, 25-banchi, 4-ban, 1-chome, Doshin, Kita-ku, Osaka-shi, Osaka-fu, Japan

[21] Appl. No.: 765,350

[22] Filed: Aug. 13, 1985

[30] Foreign Application Priority Data

| | | | |
|---|---|---|---|
| Feb. 15, 1985 | [JP] | Japan | 60-5709[U] |
| Feb. 18, 1985 | [JP] | Japan | 60-21475[U] |
| Feb. 22, 1985 | [JP] | Japan | 60-6925[U] |
| Jun. 18, 1985 | [JP] | Japan | 60-25638[U] |
| Jun. 18, 1985 | [JP] | Japan | 60-25639[U] |

[51] Int. Cl.[4] ..... B65D 85/672

[52] U.S. Cl. ..... 206/387; 206/491; 229/165; 229/182

[58] Field of Search ..... 206/45.31, 45.33, 387, 206/424, 444, 491; 229/16 A, 40, 165, 182

[56] References Cited

U.S. PATENT DOCUMENTS

| | | | |
|---|---|---|---|
| 83,812 | 11/1868 | Wilcox | 229/16 A |
| 695,205 | 3/1902 | Goodnow | 229/182 |
| 1,144,746 | 6/1915 | Ziegler | 229/182 |
| 1,838,154 | 12/1931 | Raftenberg | 229/165 |
| 1,911,952 | 5/1933 | Halladay | 229/165 |
| 2,980,308 | 4/1961 | Bolding | 229/182 |
| 3,073,502 | 1/1963 | Phin | 229/16 A |
| 3,412,921 | 11/1968 | Rekow | 229/165 |
| 3,658,240 | 4/1972 | Stoll | 229/40 |
| 3,792,811 | 2/1974 | Carpenter et al. | 206/424 |
| 4,125,189 | 11/1978 | Fujimoto et al. | 206/387 |
| 4,350,247 | 9/1982 | Garrod | 206/387 |
| 4,445,634 | 5/1984 | Sato | 206/387 |
| 4,545,483 | 10/1985 | Shiba et al. | 206/387 |

FOREIGN PATENT DOCUMENTS

| | | | |
|---|---|---|---|
| 46222 | 6/1946 | France | 229/165 |

*Primary Examiner*—Joseph Man-Fu Moy
*Assistant Examiner*—David T. Fidei
*Attorney, Agent, or Firm*—Gifford, Groh, VanOphem, Sheridan, Sprinkle and Dolgorukov

[57] ABSTRACT

The disclosed invention provides a container made of paper and comprising an end wall opposite an opening, right and left side walls extending between the end wall and the opening, and upper and lower side walls extending between the end wall and the opening. Each of the side walls has at least a double layer construction consisting of a bend part and a foldback part bonded together. Cut edges of paper are disposed inwardly of the container away from the opening.

17 Claims, 12 Drawing Figures

FOLDUP PAPER CONTAINER

BACKGROUND OF THE INVENTION

This invention relates to a container for receiving a video tape, floppy disks, or varied other articles, and more particularly to a paper container folded up to define an opening for putting such articles in and out.

A conventional foldup paper container of this type is illustrated in FIG. 8 of the accompanying drawings. As seen, a sheet of paper 01 includes bend parts 01*a* to 01*i* which constitute various parts of the container when folded up. The bend parts that will define an opening when folded up will have their edges exposed to outside.

This type of known paper container has the advantage of low cost over a container formed of plastics. However, since the edges of the bend parts defining the opening are always exposed to outside, these edges tend to be contacted by hands and articles resulting in generation of paper powder or particles as the edges wear. Because of this the illustrated paper container is not suitable for video tapes which are vulnerable to paper particles. Thus such a paper container has a limited range of use.

In order to solve or alleviate the problem, these edges may be coated with a resin such as polypropylene. However, it would necessitate an apparatus for applying the resin coating to be installed in the container production line, which would increase the equipment cost and container manufacturing cost.

SUMMARY OF THE INVENTION

This invention has been made in order to restrain the generation of paper powder or particles and provide a strong container by means of rational modification effected on part of a paper sheet.

The object of the invention, therefore, is to provide a paper container formed by folding up a sheet of paper comprising foldback parts continuous with at least those bend parts which will define an opening when the sheet is folded up to form the container. The foldback parts are adapted to be folded back inwardly of the container.

According to this invention, the foldback parts continuous with at least those bend parts which will define the opening are folded back inwardly of the container during the container forming process. Therefore the foldback parts do not have their respective edges exposed to the outside, whereby the edges are protected from contacts by hands and articles. Since the invention involves only partial modifications to the paper cutting process, the paper container is manufactured with a smaller number of manufacturing steps and a smaller number of machines than the case of coating the edges with a resin such as polypropylene.

Thus, the container according to this invention departs from the prior art container by the simple and inexpensive modification consisting in the foldback parts provided to be continuous with the bend parts of the paper sheet which will define the opening of the resulting container. Although the modification is simple and inexpensive, the container of this invention has the paper edges protected against wear due to sliding contacts by hands and articles thereby to minimize generation of paper powder or paper particles. Therefore, the paper container according to this invention is well suited for containing video tapes or floppy disks which are vulnerable to paper powder or particles. Moreover, the foldback parts advantageously act as reinforcements for the bend parts. This ensures a sufficient strength required of the container without substantially increasing the wall thickness of the container. Of course, the articles that can be placed in the container are not limited to video tapes and floppy disks, and the shape and size of the container may be chosen to suit the articles to be placed therein.

Other objects and advantages of this invention will be apparent from the following description.

DETAILED DESCRIPTION OF THE PREFERRED EMBODIMENTS

Figure 1:
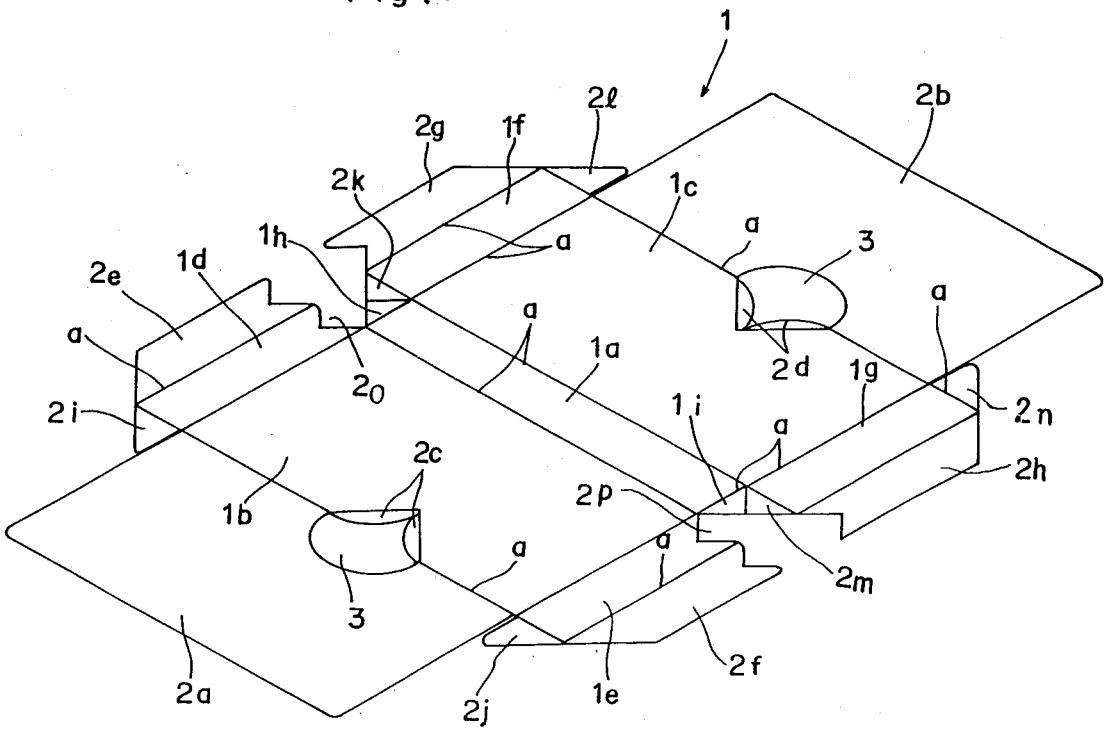
FIG. 1 is a developed perspective view of a foldup paper container according to a first embodiment of this invention.

Several embodiments of this invention will be described hereinafter with reference to the accompanying drawings.

Referring to FIGS. 1 through 5 and FIG. 9, a sheet of paper 1 is shown which is folded up to form a box or container for a video tape which is one example of articles to be placed in the container. The container defines an opening S for putting the video tape in and out. The sheet of paper 1 comprises a rectangular bend part 1*a* which constitutes a back end wall of the container, and a pair of rectangular outer bend parts 1*b* and 1*c* continuous with opposite long sides of the bend part 1*a* and constituting righthand and lefthand side walls of the container. As used throughout this disclosure, the term "bend part" refers to a substantially planar panel which is attached to at least one other substantially planar panel along a bend or fold. A "foldback part" is a bend part which is dimensioned substantially to overlie another bend part resulting in a double layer construction.

The first and second outer bend parts 1*b* and 1*c* constituting the side walls have first and second upper bend parts 1*d* and 1*f*, as well as third and fourth lower bend parts 1*e* and 1*g* continuous with short sides of the outer bend parts.

These four upper and lower bend parts 1*d* to 1*g* constitute layers of upper and lower walls of the container. The bend part 1*a* constituting the back end wall has triangular foldback parts 1*h* and 1*i* continuous with short sides thereof. The triangular foldback parts 1*h* and 1*i* are adapted to overlap the two upper bend parts 1*d* and 1*f* and the two lower bend parts 1*e* and 1*g*, respectively.

The sheet 1 further comprises first and second inner foldback parts 2*a* and 2*b* extending from those sides of the outer bend parts which define the opening S of the container. The inner foldback parts 2*a* and 2*b* are folded into the container so that cut edges thereof are located in contact with or adjacent inside faces of the bend part 1*a* constituting the end wall and of the upper and lower bend parts 1*d* to 1*g* constituting the upper and lower walls. A cutout 3 which is a combination of a triangular cutout and a semicircular cutout is defined at a vertically intermediate position between each of the outer bend parts 1*b* and 1*c* and each of the inner foldback parts 2*a* and 2*b*. These cutouts 3 facilitate putting the video tape in and out. The outer bend parts 1*b* and 1*c* include foldback tabs 2*c* and 2*d* continuous therewith at edges of the triangular cutouts, respectively. These foldback tabs 2*c* and 2*d* are folded to contact or lie adjacent to edges of the semicircular cutouts defined in the inner foldback parts 2*a* and 2*b*.

Figure 9:
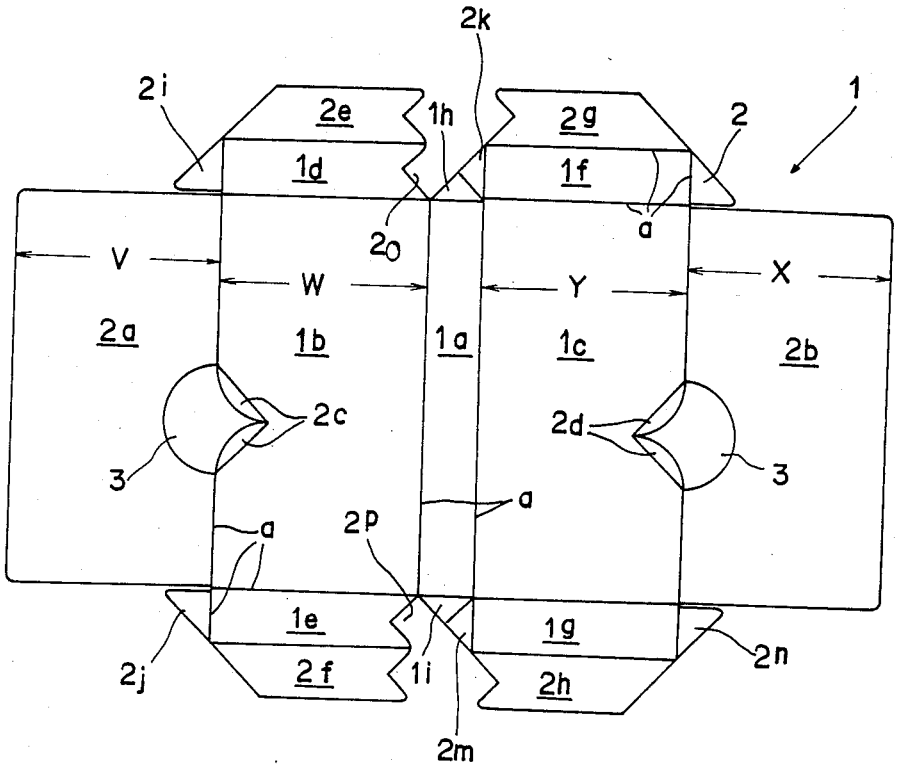
FIG. 9 is a developed plan view of the first embodiment.

As shown in FIG. 9, the first inner foldback part 2*a* has a width W substantially equal to a width V of the first outer bend part 1*b*, and the second inner foldback part 2*b* has a width X substantially equal to a width Y of the second outer bend part 1*c*.

The width W is equal to the width Y.

The upper bend parts 1*d* and 1*f* constituting the upper wall have first and second upper foldback parts 2*e* and 2*g* continuous with long sides thereof, respectively. The lower bend parts 1*e* and 1*g* have third and fourth lower foldback parts 2*f* and 2*h* continuous with long sides thereof respectively. The upper and lower foldback parts 2*e* to 2*h* are folded so that edges thereof are placed in contact with or adjacent the outer bend parts 1*b* and 1*c* constituting the side walls of the container. The upper and lower bend parts 1*d* to 1*g* constituting the upper and lower walls of the container further include triangular foldback parts 2*i* to 2*n* and triangular cutouts 2*o* and 2*p* at short sides thereof. These foldback parts 2*i* to 2*n* and cutouts 2*o* and 2*p* have edges overlapping the triangular foldback parts 1*h* and 1*i* or placed in contact with or adjacent to edges of the triangular foldback parts 1*h* and 1*i*.

Figure 2:
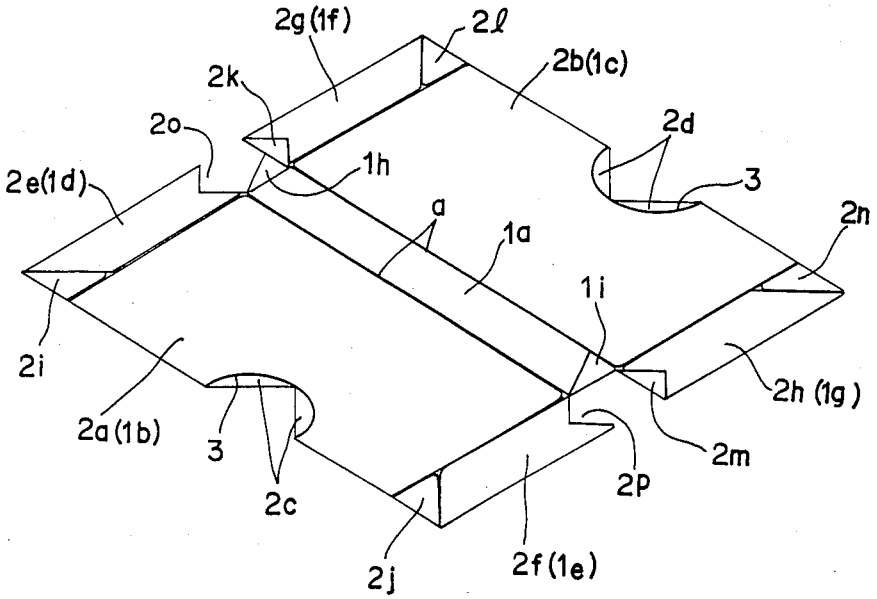
FIGS. 2 and 3 are perspective views showing a foldup process, respectively.
Figure 3:
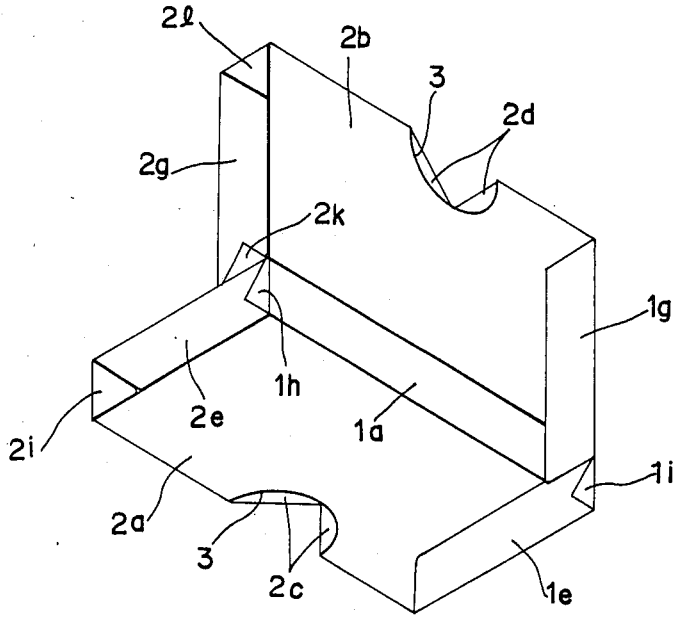
Figure 5:
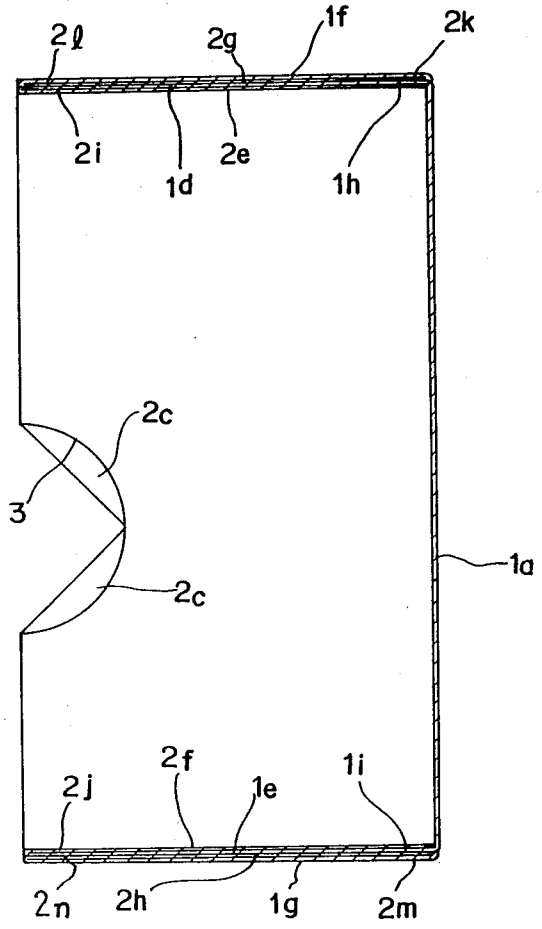
FIG. 5 is a sectional view taken on line V—V of FIG. 4.
Figure 4:
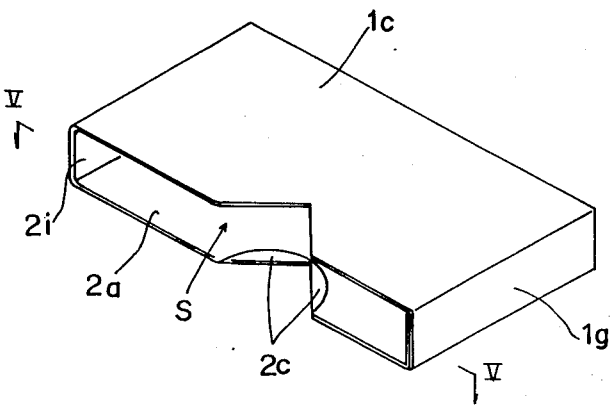
FIG. 4 is a perspective view of the container as folded up.

When the sheet 1 is folded up to form the container, the foldback parts 2*a* to 2*n* continuous with the sides of the bend parts 1*a* to 1*g* are folded inwardly on the container as shown in FIG. 2. Therefore, the cut edges of the foldback parts are protected from sliding contacts by hands and articles. Compared for example with the case of cut edges of the sheet being exposed to outside, the construction of this invention restrains generation of paper powder or particles due to frictions caused by such sliding contacts. The described embodiment further diminishes the generation of paper powder or articles from those edges of the foldback parts 2*a* to 2*n* by placing the edges in contact with or adjacent to the other components when the sheet 1 is folded up.

Where the sheet of paper 1 has inner bend walls coated with a thermoplastic resin such as polyethylene or polypropylene in a thickness of 25–30 microns, the bend parts and foldback parts may be thermally fused together by using an existing polyethylene or polypropylene container manufacturing plant without any modification to the plant and without using an adhesive. The constituent parts may of course be bonded together by means of an adhesive.

It will be noted that reference a in the drawings denotes fold lines along which the bend parts and foldback parts may be folded in an accurate and reliable manner.

The other embodiments will be described hereinafter.

Figure 6:
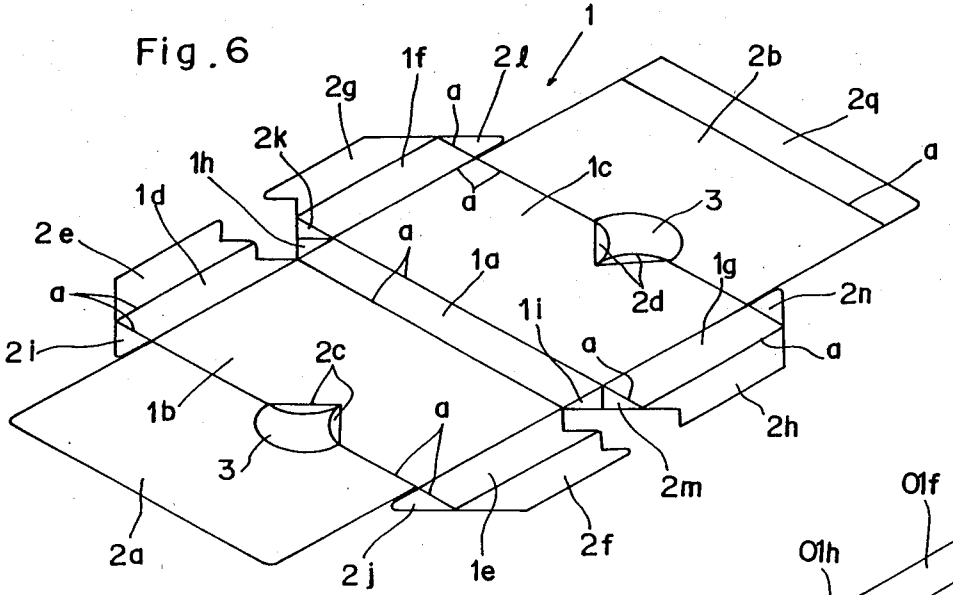
FIG. 6 is a developed perspective view of a second embodiment.
Figure 8:
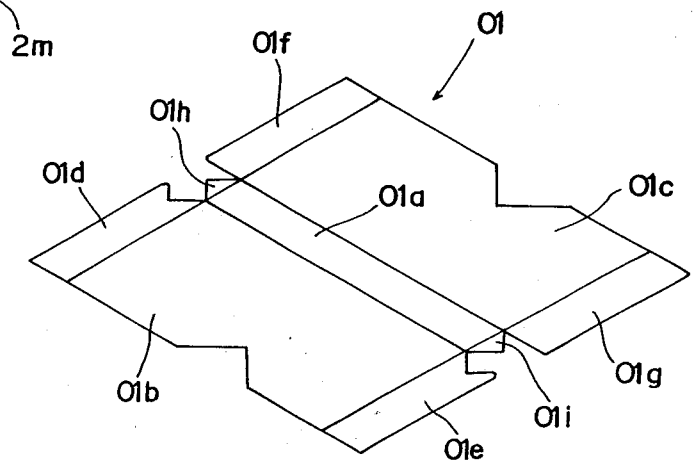
Fig. 8 (Prior Art)
FIG. 8 is a developed perspective view of a foldup paper container according to the prior art.

Referring to FIG. 6 showing a second embodiment, the sheet of paper 1 further comprises a reinforcing inner foldback part 2*q* continuous with one of the inner foldback parts 2*a* and 2*b*. This reinforcing foldback part 2*q*, when the sheet 1 is folded up to form a container, overlaps an inside face of the bend part 1*a* constituting the end wall of the container.

Figure 7:
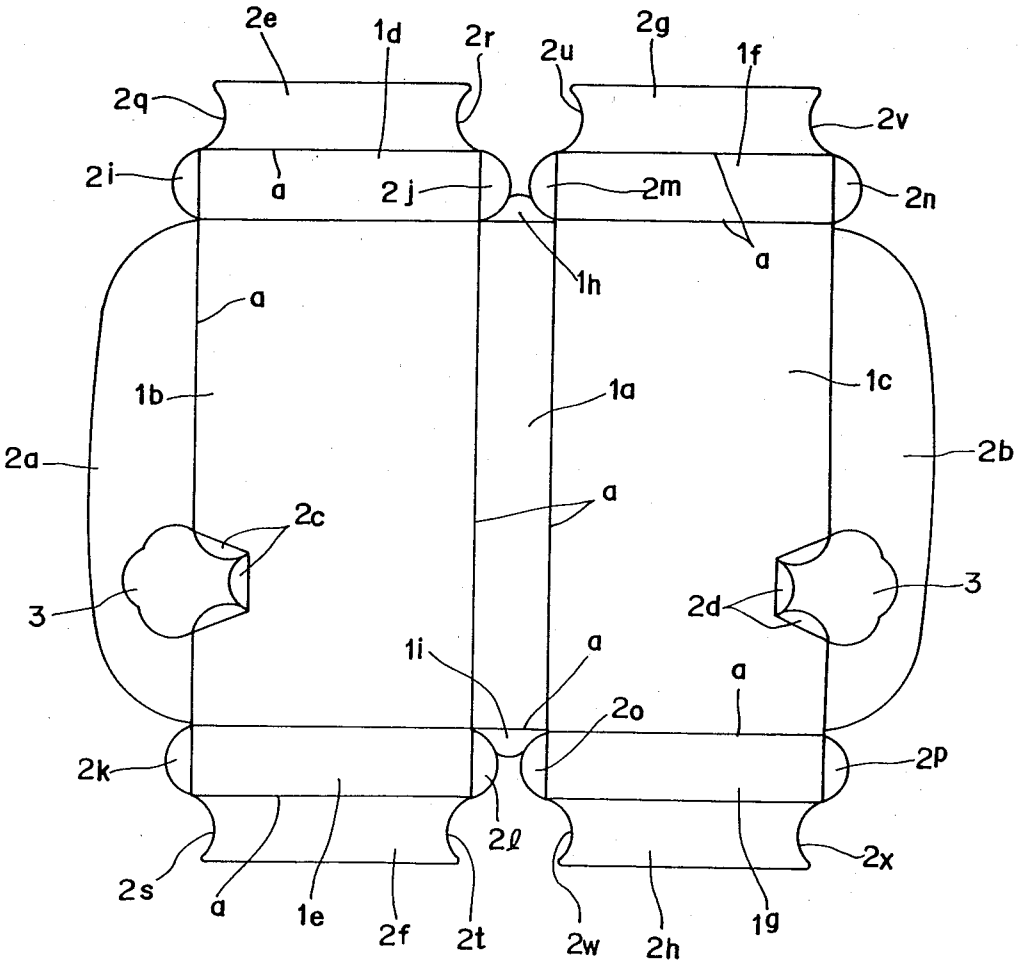
FIG. 7 is a developed plan view of a third embodiment.

Referring to FIG. 7 showing a third embodiment, the sheet of paper 1 includes foldback parts 2*a* and 2*b* each in a shape of half ellipse smaller in area than the bend part 1*b* or 1*c* constituting an outer side wall of the container. The upper and lower bend parts 1*d* to 1*g* constituting the upper and lower walls of the container have semicircular tabs or foldback parts 2*i* to 2*p* continuous with short sides thereof. The upper and lower foldback parts 2*e* to 2*h* define corresponding semicircular cutouts 2*q* to 2*x* at short sides thereof for mating with the semicircular foldback parts 2*i* to 2*p*.

Furthermore, in the third embodiment the cutouts 3 for facilitating putting in and out of the video tape each include a convex trapezoidal cutout having three semicircular tabs or foldback parts 2*c* or 2*d* which are placed in contact with or adjacent to edges of three semicircular concavities defined in the foldback part 2*a* or 2*b*.

Figure 10:
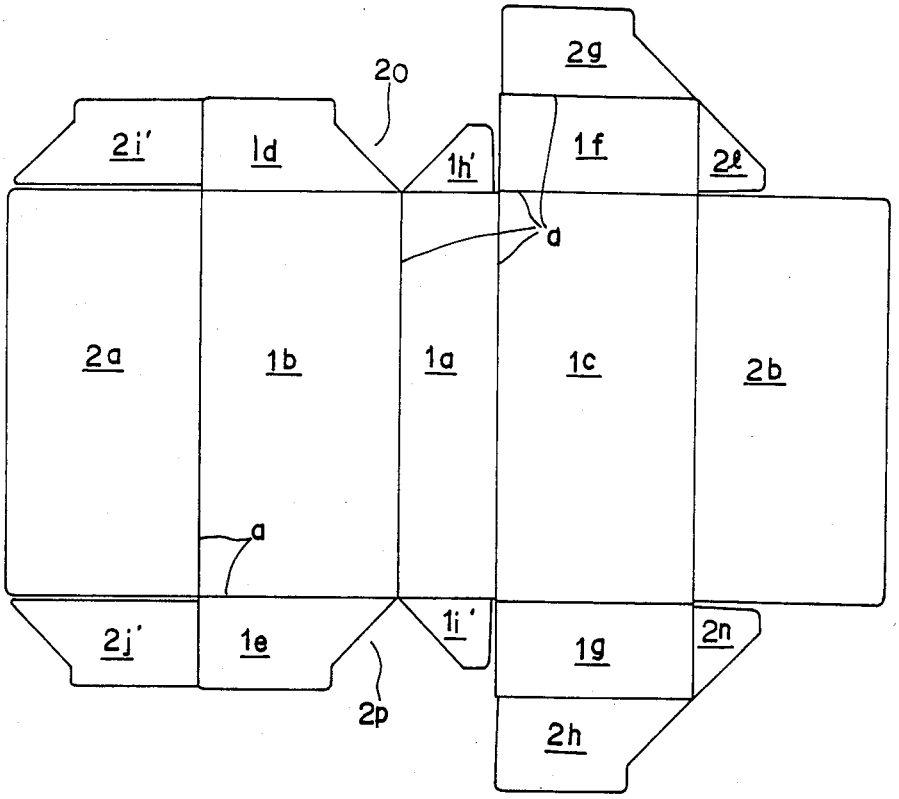
FIG. 10 is a developed plan view of a fourth embodiment.

Referring to FIG. 10 showing a fourth embodiment, the sheet includes no parts corresponding to the foldback parts 2*e* and 2*f* and the triangular foldback parts 2*k* and 2*m* in the first embodiment shown in FIG. 9. Triangular foldback parts 2*i'* and 2*j'* in this embodiment are longer than the corresponding parts 2*i* and 2*j* of FIG. 9 and substantially equal an entire width of the main foldback part 2*a*. Thus, the upper and lower bend parts 1*d* to 1*g* are reinforced with added rigidity by the upper and lower foldback parts 2*i'* and 2*j'* when the sheet is folded up to form a container. However, no cutouts are defined in the sheet.

Figure 11:
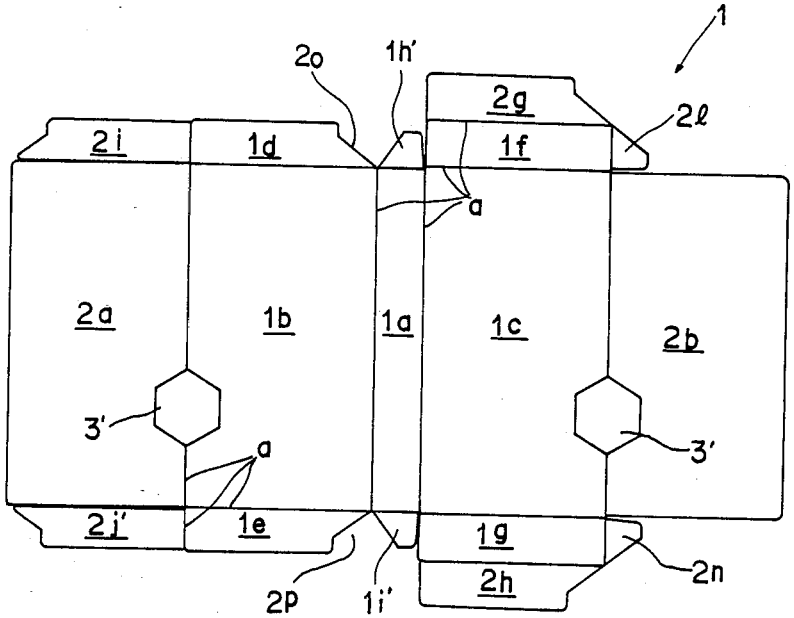
FIG. 11 is a developed plan view of a fifth embodiment.

Referring to FIG. 11, a fifth embodiment shown therein differs from the embodiment of FIG. 10 in that a hexagonal cutout 3' is defined between the first outer bend part 1*b* and the first inner foldback part 2*a* and a similar cutout 3' is defined between the second outer bend part 1*c* and the second inner foldback part 2*b*. Thus, the fifth embodiment has an advantage over the fourth embodiment in that an article such as a video tape may be put in and out with ease.

Figure 12:
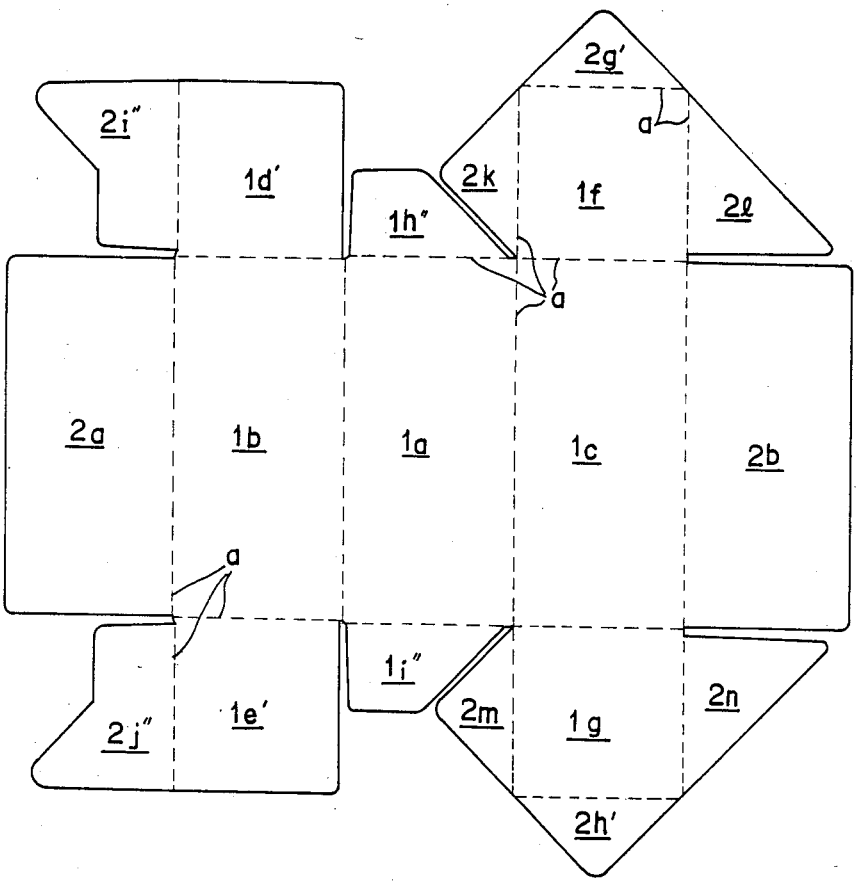
FIG. 12 is a developed plan view of a sixth embodiment.

FIG. 12 shows a sixth embodiment which comprises a paper container suited for floppy disks. This embodiment is different from the embodiment of FIG. 9 in the following respects:

(i) Foldback parts 2*i''* and 2*j''* are larger than the foldback parts 2*i* and 2*j*.

(ii) The foldback parts 2*e* and 2*f* are not provided.

(iii) Bend parts 1*h''* and 1*i''* are larger than the bend parts 1*h* and 1*i*.

(iv) The foldback parts 2*g'* and 2*h'* are triangular.

(v) The parts 1*h''* and 2*k* are not continuous.

(vi) The cutouts 3 are not provided.

(vii) The bend parts 1*d'* and 1*e'* include no cutouts.

The sixth embodiment, however, is the same in principle as the first embodiment shown in FIG. 9.

I claim:

1. A foldup paper container having an opening (S) for putting articles in and out, comprising:

a rectangular back end wall opposite said opening (S) and formed of a single layer bend part (1*a*);

a rectangular righthand side wall extending forwardly from said back end wall, said righthand side wall having at least partly a double layer construction comprising a first outer bend part (1*c*) and a first inner foldback part (2*b*) joined together;

a rectangular lefthand side wall extending forwardly from said back end wall and at the same time opposed to said righthand side wall, said lefthand side wall having at least partly a double layer construction comprising a second outer bend part (1*b*) and a second inner foldback part (2*a*) joined together;

a rectangular upper side wall extending forwardly from said back end wall, said upper side wall having substantially a four layer construction comprising a first upper bend part (1*f*), a second upper bend part (1*d*), a first upper foldback part (2*g*) and a second upper foldback part (2*e*), said first upper bend part (1*f*) and said first upper foldback part (2*g*) having an equal width and being joined together, also said second upper bend part (1*d*) and said second upper foldback part (2*e*) having an equal width and being joined together; and a rectangular lower side wall extending forwardly from said back end wall and at the same time opposed to said upper side wall, said lower side wall having substantially a four layer construction comprising a third lower bend part (1*g*), a fourth lower bend part (1*e*), a third lower foldback part (2*h*) and a fourth lower foldback part (2*f*), said third lower bend part (1*g*) and said third lower foldback part (2*h*) having an equal width and being joined together, also said fourth lower bend part (1*e*) and said fourth lower foldback part (2*f*) having an equal width and being joined together; wherein:

said first inner foldback part (2*b*), said first upper foldback part (2*g*), said second inner foldback part (2*a*), said third lower foldback part (2*h*), said second upper foldback part (2*e*), and said fourth lower foldback part (2*f*) respectively have cut-off edges thereof disposed inwardly of said opening (S);

said first upper foldback part (2*g*), said first upper bend part (1*f*), said first outer bend part (1*c*), said third lower bend part (1*g*) and said third lower foldback part (2*h*) are, in an unfolded state of said foldup paper container, connected to one another serially in the mentioned order, and also the other constituting parts, i.e. said first inner foldback part (2*b*), said first outer bend part (1*c*), said single layer bend part (1*a*), said second outer bend part (1*b*), said second inner foldback part (2*a*), said second upper foldback part (2*e*), said second upper bend part (1*d*), said second outer bend part (1*b*), said fourth lower bend part (1*e*) and said fourth lower foldback part (2*f*) are, in the unfolded state of said foldup paper container, connected to one another serially in the mentioned order;

said first upper foldback part (2*g*), said third lower foldback part (2*h*), said second upper foldback part (2*e*) and said fourth upper foldback part (2*f*) respectively define a cutout while a first side foldback part (21), a second side foldback part (2*i*), a third side foldback part (2*n*) and a fourth side foldback part (2*j*) respectively have a triangular form, such that said side foldback parts (21), (2*i*), (2*n*), (2*j*) are folded to be fitted into said cutouts of said foldback parts (2*g*), (2*h*), (2*e*), (2*j*) corresponding thereto, respectively; and a first triangular foldback part (1*h*) and a third triangular foldback part (1*i*) both extend from said back end wall (1*a*) while a second triangular foldback part (2*k*) and a fourth triangular foldback part (2*m*) respectively extend from said first upper bend part (1*f*) and from said third lower bend part (1*g*), said first triangular foldback part (1*h*) and said second triangular foldback part (2*k*) and also said third triangular foldback part (1*i*) and said fourth triangular foldback part (2*m*) respectively form a triangle in combination to be fitted into cutouts (2*o*), (2*p*) each concavely defined in said second upper bend part (1*d*) and in said fourth lower bend part (1*e*) respectively when said foldup paper container is folded in half.

2. A foldup paper container, as defined in claim 1, wherein said second inner foldback part (2*a*) and said second outer bend part (1*b*) have substantially an equal width and also said first inner foldback part (2*b*) and said first outer bend part (1*c*) have substantially an equal width, said widths being equal to each other.

3. A foldup paper container, as defined in claim 2, wherein said second inner foldback part (2*a*) and said first inner foldback part (2*b*) define substantially semicircular cutouts (3) opposed to each other across said opening (S) while said second outer bend part (1*b*) and said first outer bend part (1*c*) adjacent said first and second inner foldback parts (2*b*), (2*a*) define triangular cutouts (3) formed continuously with said cutouts (3), said triangular cutouts (3) having at edges thereof foldback parts (2*c*), (2*d*) for covering edges of said semicircular cutouts (3).

4. A foldup paper container, as defined in claim 1, wherein said joining is effected with an adhesive.

5. A foldup paper container, as defined in claim 1, wherein said joining is effected through thermal fusion of thermoplastic resin coated on inner faces of said bend parts.

6. A foldup container formed from a single sheet comprising:

a first rectangular bend part having a pair of long sides and a pair of short sides;

first and second rectangular outer bend parts each having a pair of long sides, one each of which adjoins a respective one of the long sides of the first bend part, and each having a pair of short sides;

first and second inner foldback parts each having a long side adjoining the other long side of said first and second outer bend parts respectively, said inner foldback parts each having a width not greater than the short sides of said outer bend parts and a length substantially equal to the long sides of said outer bend parts;

first and second upper bend parts, each having a length, a width and at least a pair of parallel sides, one each of which adjoins a respective one of said first and second outer bend parts along a short side thereof;

third and fourth lower bend parts, each having a length, a width and at least a pair of parallel sides, one each of which adjoins a respective one of said first and second outer bend parts along the other short side thereof;

first and second upper foldback parts, each having a side adjoining another side of said first and second upper bend parts respectively, said upper foldback parts each having a length and width not greater than the length and width of the respective upper bend part which it adjoins; and third and fourth lower foldback parts, each having a side adjoining another side of said third and fourth lower bend parts respectively, said lower foldback parts each having a length and width not greater than the length and width of the respective lower bend part which it adjoins;

wherein said foldup container includes a back end wall comprising said first bend part; a pair of opposed two layer sidewalls each comprising one of said inner foldback parts folded back onto a respective one of said outer bend parts along the long side on which they adjoin; a four layer upper side wall comprising said first and second upper foldback parts folded back onto said first and second upper bend parts respectively, which, in turn, overlap one another; a four layer lower side wall comprising said third and fourth lower foldback parts folded back onto said third and fourth lower bend parts, respectively, which, in turn, overlap one another; and an opening opposite said back end wall defined by the folded edges of said two layer side walls and said upper and lower side walls.

7. The container as defined in claim 6 wherein said first rectangular bend part further comprises two tabs disposed along the short sides thereof, and wherein one of said first and second upper bend parts and one of said third and fourth lower bend parts have notches corresponding in shape to said tabs so that said back end wall is joined to said upper and lower sidewalls by said tabs.

8. The foldup container as defined in claim 6 wherein said first and second inner foldback parts each are rectangular having two long sides, and each have a width substantially equal to the short sides of said first and second outer bend parts so that, when folded, the other long side of each of said inner foldback parts lies adjacent said first rectangular bend part.

9. The foldup container as defined in claim 8 and comprising a rectangular reinforcing inner foldback part having a long side ajoining the other long side of one of said first and second inner foldback parts and dimensioned to overlie said first rectangular end wall when the container is folded.

10. The foldup container as defined in claim 6 and comprising a cutout disposed in each of said two layer sidewalls, along the long side adjoining the outer bend parts and the inner foldback parts, equal distances from said lower sidewall.

11. The foldup container as defined in claim 10 wherein said cutouts are triangular in shape and include a semicircular cut in each of said inner foldback parts and a convex V shaped cut in each of said outer bend parts, aligned with said semicircular cuts so that, when said inner foldback parts are folded onto said outer bend parts, a pair of tabs formed by the convexity of the V-shaped cuts fold over to nest in each of said semicircular cuts, the folds of said tabs each forming a side of the triangular cutout.

12. The foldup container as defined in claim 10 wherein said cutouts are in the shape of an isosceles trapezoid having its base on the long side adjoining the outer bend parts and the inner foldback parts.

13. The foldup container as defined in claim 12 wherein said trapezoidal cutouts include a concave trapezoidal cut in each of said inner foldback parts and a corresponding convex trapezoidal cut in each of said outer bend parts so that, when said inner foldback parts are folded onto said outer bend parts, a trio of tabs formed by the convexities of each of the convex trapezoidal cuts fold over to nest in the concavities of each of said concave trapezoidal cuts, the folds of said tabs each forming a side of the trapezoidal cut out.

14. The foldup container as defined in claim 6 wherein each of said upper and lower bend parts is rectangular in shape, each having a pair of short sides and a pair of long sides, one of said long sides adjoining said respective outer bend part, and wherein each of said short sides of said upper and lower bend parts includes a tab dimensioned to nest with a corresponding notch in a respective one of said upper and lower foldback parts, when said upper and lower foldback parts are folded back onto said upper and lower bend parts.

15. The foldup container as defined in claim 6 wherein said upper and lower bend parts are each substantially rectangular with said pair of parallel sides being a pair of long sides, and wherein each of said upper and lower foldback parts adjoins the other long side of said respective one of said upper and lower bend parts.

16. The foldup container as defined in claim 7 wherein said upper and lower bend parts are each substantially rectangular with said pair of parallel sides being a pair of long sides, and wherein said first upper and said third lower foldback parts adjoin the other long side of said first upper and said third lower bend parts respectively, and said second upper and said fourth lower foldback parts adjoin a short side of said second upper and said fourth lower bend parts, respectively.

17. The foldup container as defined in claim 6 wherein each of said foldback parts is adhered to its respective bend part.

* * * * *